US008021453B2

(12) United States Patent
Howes

(10) Patent No.: US 8,021,453 B2
(45) Date of Patent: Sep. 20, 2011

(54) COLLECTING CHAMBER FOR A VACUUM CLEANER

(75) Inventor: Gordon James Howes, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 0 days.

(21) Appl. No.: 12/439,473

(22) PCT Filed: Aug. 23, 2007

(86) PCT No.: PCT/GB2007/003207

§ 371 (c)(1),
(2), (4) Date: Jul. 24, 2009

(87) PCT Pub. No.: WO2008/025955

PCT Pub. Date: Mar. 6, 2008

(65) Prior Publication Data

US 2010/0024367 A1 Feb. 4, 2010

(30) Foreign Application Priority Data

Sep. 1, 2006 (GB) ..... 0617181.3

(51) Int. Cl.
*A47L 5/36* (2006.01)

(52) U.S. Cl. ..... 55/447; 55/428; 55/429; 55/430; 55/431; 55/432; 55/DIG. 3; 15/352; 15/353; 15/347

(58) Field of Classification Search ..... 55/428, 55/429–433, DIG. 3; 15/352, 353, 347
See application file for complete search history.

(56) References Cited

U.S. PATENT DOCUMENTS

| | | | | |
|---|---|---|---|---|
| 6,026,540 | A * | 2/2000 | Wright et al. | 15/347 |
| 7,146,681 | B2 * | 12/2006 | Wright et al. | 15/353 |
| 7,175,682 | B2 * | 2/2007 | Nakai et al. | 55/429 |
| 7,655,060 | B2 * | 2/2010 | Nakai et al. | 55/429 |
| 7,682,414 | B2 * | 3/2010 | Yoshida et al. | 55/429 |
| 7,740,676 | B2 * | 6/2010 | Burnham et al. | 55/345 |
| 2001/0039692 | A1 * | 11/2001 | Wright et al. | 15/353 |
| 2005/0198770 | A1 * | 9/2005 | Jung et al. | 15/353 |
| 2005/0217066 | A1 * | 10/2005 | Bair et al. | 15/347 |

(Continued)

FOREIGN PATENT DOCUMENTS

EP 0042723 12/1981

(Continued)

OTHER PUBLICATIONS

GB Search Report dated Nov. 27, 2006, directed to counterpart GB Patent Application No. 0617171.3; 1 page.

(Continued)

*Primary Examiner* — Jason M Greene
*Assistant Examiner* — Dung H Bui
(74) *Attorney, Agent, or Firm* — Morrison & Foerster LLP

(57) ABSTRACT

A bagless vacuum cleaner includes a separating unit for separating dirt and dust from a dirt-laden airflow which is drawn in by the cleaner. The separating unit has a chamber with collection areas for collecting dirt and dust which is separated from the airflow. A base of the separating unit is movable between a closed position and an open position. A dividing wall between the collection areas is arranged so that its end is spaced from the base by different distances at different respective regions. This enables an enlarged opening, by which dirt and dust can be emptied from the chamber, to be provided, which facilitates emptying of the chamber.

17 Claims, 7 Drawing Sheets

U.S. PATENT DOCUMENTS

| | | | |
|---|---|---|---|
| 2006/0037172 | A1 | 2/2006 | Choi |
| 2006/0101611 | A1 | 5/2006 | Oh et al. |

FOREIGN PATENT DOCUMENTS

| | | |
|---|---|---|
| EP | 1676516 | 10/2005 |
| EP | 1629758 | 3/2006 |
| GB | 2418877 | 4/2006 |
| WO | WO-02/067752 | 9/2002 |

OTHER PUBLICATIONS

International Preliminary Report on Patentability, mailed Dec. 18, 2008, directed to counterpart International Patent Application No. PCT/GB2007/003207; 8 pages.

International Search Report and Written Opinion, mailed Dec. 27, 2007, directed to counterpart International Patent Application No. PCT/GB2007/003207; 14 pages.

* cited by examiner

COLLECTING CHAMBER FOR A VACUUM CLEANER

REFERENCE TO RELATED APPLICATIONS

This application is a national stage application under 35 USC 371 of International Application No. PCT/GB2007/003207, filed Aug. 23, 2007, which claims the priority of United Kingdom Application No. 0617181.3, filed Sep. 1, 2006, the contents of which prior applications are incorporated herein by reference.

FIELD OF THE INVENTION

This invention relates to a collecting chamber for a bagless vacuum cleaner and to a vacuum cleaner which incorporates the collecting chamber.

BACKGROUND OF THE INVENTION

Vacuum cleaners which separate dirt and dust from an airflow without the use of a filter bag, so-called bagless vacuum cleaners, are becoming increasingly popular. Most bagless cleaners use cyclonic or centrifugal separation to spin dirt and dust from the airflow. By avoiding the use of a filter bag as the primary form of separation, it has been found possible to maintain a consistently high level of suction, even as the collecting chamber fills with dirt.

The principle of cyclonic separation in domestic vacuum cleaners is described in a number of publications including EP 0 042 723. In general, an airflow in which dirt and dust is entrained enters a first cyclonic separator via a tangential inlet which causes the airflow to follow a spiral or helical path within a collection chamber so that the dirt and dust is separated from the airflow. Relatively clean air passes out of the chamber whilst the separated dirt and dust is collected therein. In some applications, and as described in EP 0 042 723, the airflow is then passed to a second cyclone separator which is capable of separating finer dirt and dust than the upstream cyclone. The airflow is thereby cleaned to a greater degree so that, by the time the airflow exits the cyclonic separating apparatus, the airflow is almost completely free of dirt and dust particles. A dividing wall separates the collection regions associated with the first and second stage cyclone separators.

While bagless vacuum cleaners are successful in maintaining a consistently high level of suction, the absence of a bag can make it difficult to dispose of the dirt and dust which is collected by the cleaner. When the separating chamber of a bagless cleaner becomes full, a user typically removes the collecting chamber from the chassis of the machine, carries the chamber to a dust bin or refuse sack and tips the chamber upside down.

EP 1361814 describes a dust-collecting device for a cyclonic vacuum cleaner. The dust-collecting chamber can be removed from the chassis of the cleaner for emptying. A bottom lid of the dust-collecting chamber is attached by way of a hinge to the remainder of the chamber and the lid can be released by pressing a release button. Seals are provided in order to seal the bottom lid to the chamber. Without a reliable seal, air and dust will escape from the chamber and the separation efficiency of the vacuum cleaner will be reduced.

A problem which may be encountered with such vacuum cleaners is that the wall dividing the dust collection chamber into different collection regions typically occupies a relatively large volume within the dust collection chamber and so may inhibit efficient emptying and cleaning of the collection chamber.

SUMMARY OF THE INVENTION

The invention provides a collecting chamber for a bagless vacuum cleaner comprising a chamber wall, a chamber base, first and second stage collection regions for collecting, in use, dirt and dust which has been separated from an airflow and a dividing wall between the collection areas, in which the end of the dividing wall is spaced from the base by different distances at different respective regions.

The provision of a dividing wall that does not have a constant separation with respect to the base permits a wall having a region of greater separation from the base to be employed, which facilitates emptying of the chamber.

Preferably, the end of the wall is inclined with respect to the chamber base, so that the end of the wall has a gradient.

Advantageously, the end of the wall is defined by a seal, arranged to seal against an upstanding portion of the base. This seals the first collecting region from the second collecting region.

Preferably, the base is hinged so as to be pivotable between a closed position and an open position. Dirt and dust can escape from the collection areas when the base is in the open position.

Advantageously, the hinge is mounted in a recess in the collecting chamber wall, and the end of the dividing wall is arranged so that the region of greatest separation from the base is that closes to the recessed region. This feature provides a larger spacing in the vicinity of the recess, so that opening by which dirt and dust can escape is greater than was achievable hitherto.

The term 'bagless' is intended to cover a broad range of vacuum cleaners which have a reusable collecting chamber, and includes, inter alia, cleaners which separate dirt and dust by way of cyclonic, centrifugal or inertial separation.

The collecting chamber preferably comprises a cyclonic separator where dirt-laden air is spun at high speed to centrifugally separate dirt from the airflow but it can be any form of bagless separator where the collection chamber is reused after it has been emptied.

BRIEF DESCRIPTION OF THE DRAWINGS

The invention will now be described, by way of example, with reference to the accompanying drawings in which.

Like reference numerals refer to like parts throughout the specification.

DETAILED DESCRIPTION OF THE INVENTION

Figure 1:
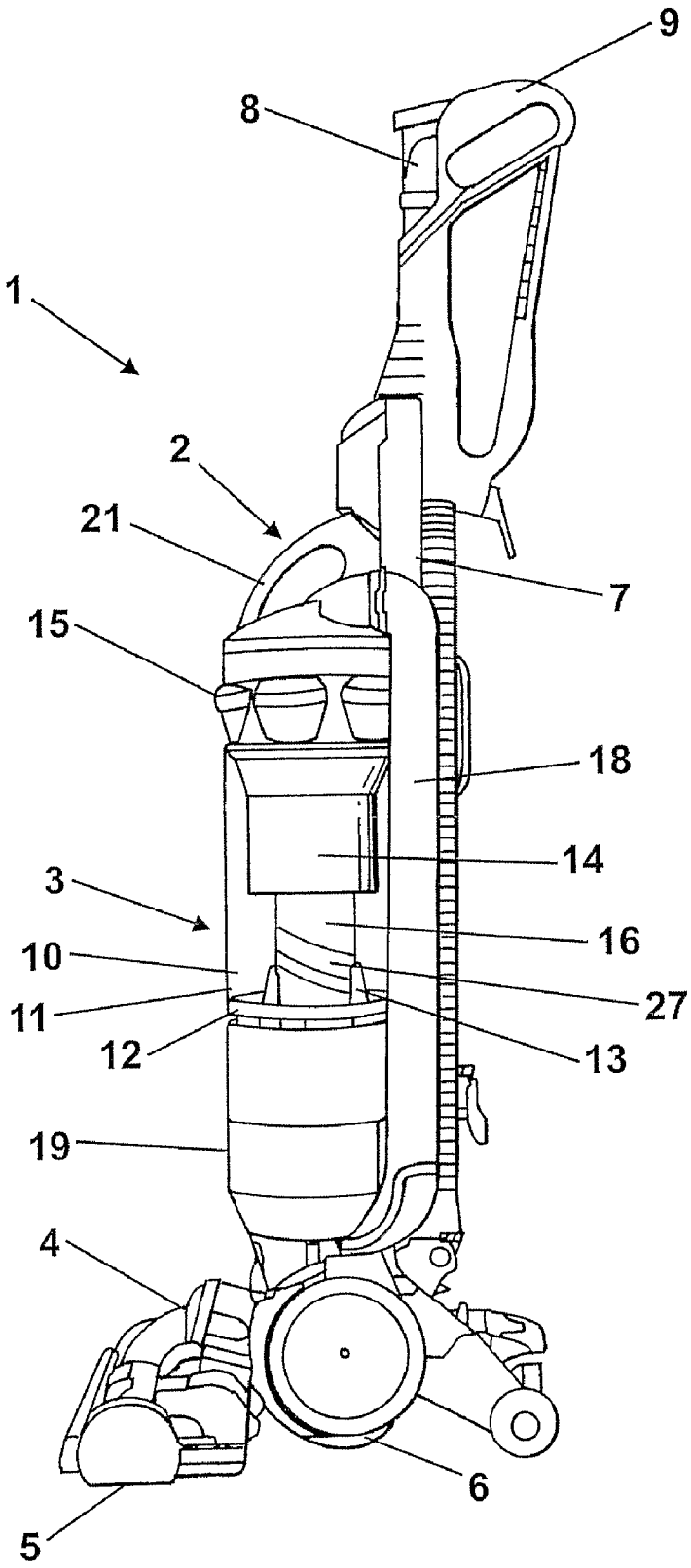
FIG. 1 is a side view of a bagless vacuum cleaner incorporating a collection chamber constructed according to the invention.

With reference to FIGS. 1 to 4, a vacuum cleaner, indicated generally by the reference numeral 1, has a main chassis 2 which supports dirt and dust separation apparatus 3. The lower part of the cleaner 1 comprises a cleaner head 4 for engaging with the floor surface. The cleaner head 4 has a downwardly facing suction inlet 5. A brush bar (not visible in these drawings) is mounted in the mouth of the inlet 5 for agitating a floor surface during a cleaning operation. The cleaner head 4 is pivotably mounted to the main chassis 2, and a rolling support assembly 6 is provided for supporting the cleaner 1 and allowing movement across a floor surface. A spine 7 of the chassis 2 extends upwardly and provides support for the components of the cleaner 1. A cleaning wand 8 is provided to allow a user to carry out above-the-floor cleaning and cleaning in places which are inaccessible by the main cleaning head 4. When the wand 8 is fixed to the spine 7, the wand forms the handle of the cleaner. A handgrip 9 at the remote end of the wand 8 allows a user to manoeuvre the cleaner.

In use, dirty air which is laden with dirt, dust and other debris is carried from the cleaner head 4 or an inlet of the wand 8 to the dirt and dust separation unit 3. In this embodiment, the dirt and dust separation unit 3 is a cyclonic separator which spins dirt, dust and other debris out of the airflow by centrifugal separation. Dirty air enters the first separation stage, which comprises a substantially cylindrically-walled cyclonic chamber 10, and follows a spiral path around the chamber. The centrifugal force acting on the material in the airflow causes the larger debris and dirt to be separated from the airflow. This separated material collects in a first collection region 11 at the base 12 of the chamber 10, due to a combination of gravity and the pressure gradient which exists in the chamber while the cleaner 1 is in operation. Baffles 13 on the interior of the chamber wall prevent re-entrainment of dirt into the airflow as it flows around the chamber.

The airflow then passes through a shroud 14. The shroud 14 causes air to perform a sharp change of direction and causes fibrous material to collect on its outer wall. The airflow then passes to a second separation stage, which comprises a set 15 of tapered cyclonic chambers arranged in parallel with one another. Air enters respective chambers via tangential inlets and is then constrained to follow a spiral path of decreasing radius which greatly increases the speed of the airflow. The speed is sufficient to separate dirt and extremely fine dust from the airflow. The dirt and dust separated here falls under gravity towards the base 12 of the chamber 10 through a conduit formed by a dividing wall 16. The wall 16 divides the first collection region 11 associated with the first stage of separation from a second collection region 17 (FIGS. 2*b*, 3 and 4) associated with the second stage of separation.

The airflow then exits the set 15 of cyclonic chambers via individual outlets which communicate with an outlet conduit 18 on the spine 7 of the chassis 2. The airflow is then directed through a motor unit 19 housing a pre-motor filter, a fan driven by a motor and post-motor filter before finally being exhausted from the cleaner 1.

Figure 2A:
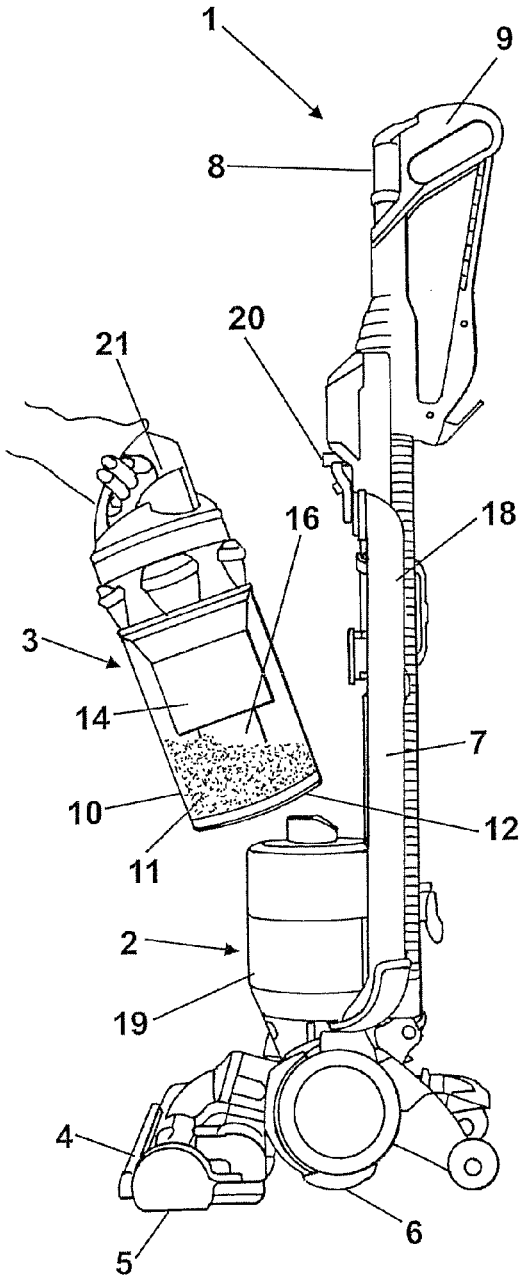
FIG. 2*a* shows the collection chamber being removed from the vacuum cleaner of FIG. 1.

The separator unit 3 is releasably held upon the chassis 2 by a catch 20, shown more clearly in FIG. 2*a*. The separator unit 3 is releasable from the chassis 2 to allow the separator to be emptied. A handle 21 is provided at the top of the separator unit 3 for allowing a user to carry the unit. The base 12 of the separator unit 3 is movable between a closed position (shown in FIGS. 2*a* and 3) and an open position (shown in FIGS. 2*b* and 4) to permit emptying of the unit 3.

Figure 2B:
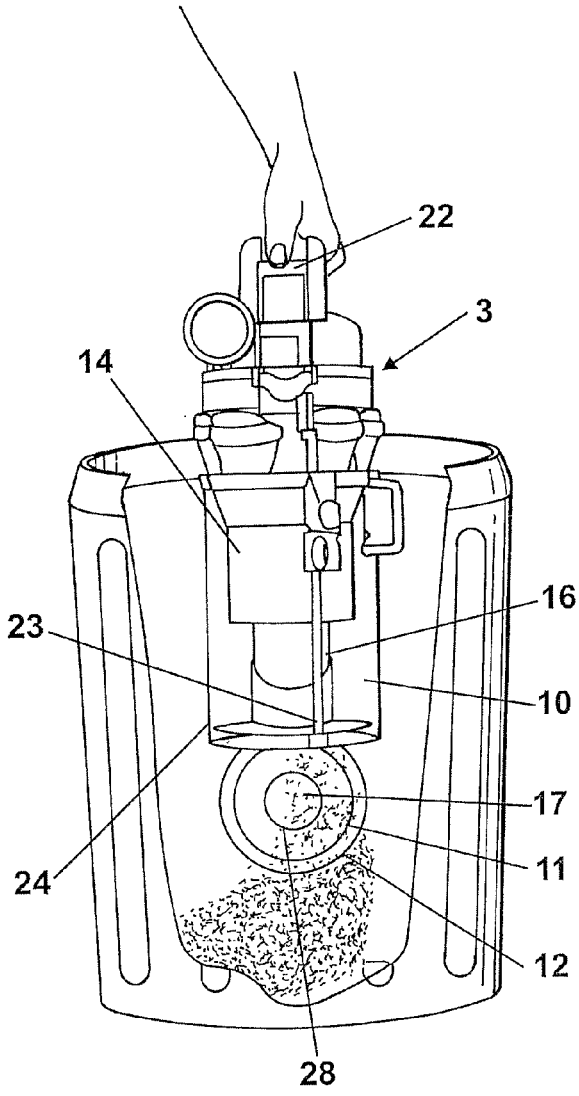
FIG. 2*b* shows the collection chamber being emptied.
Figure 3:
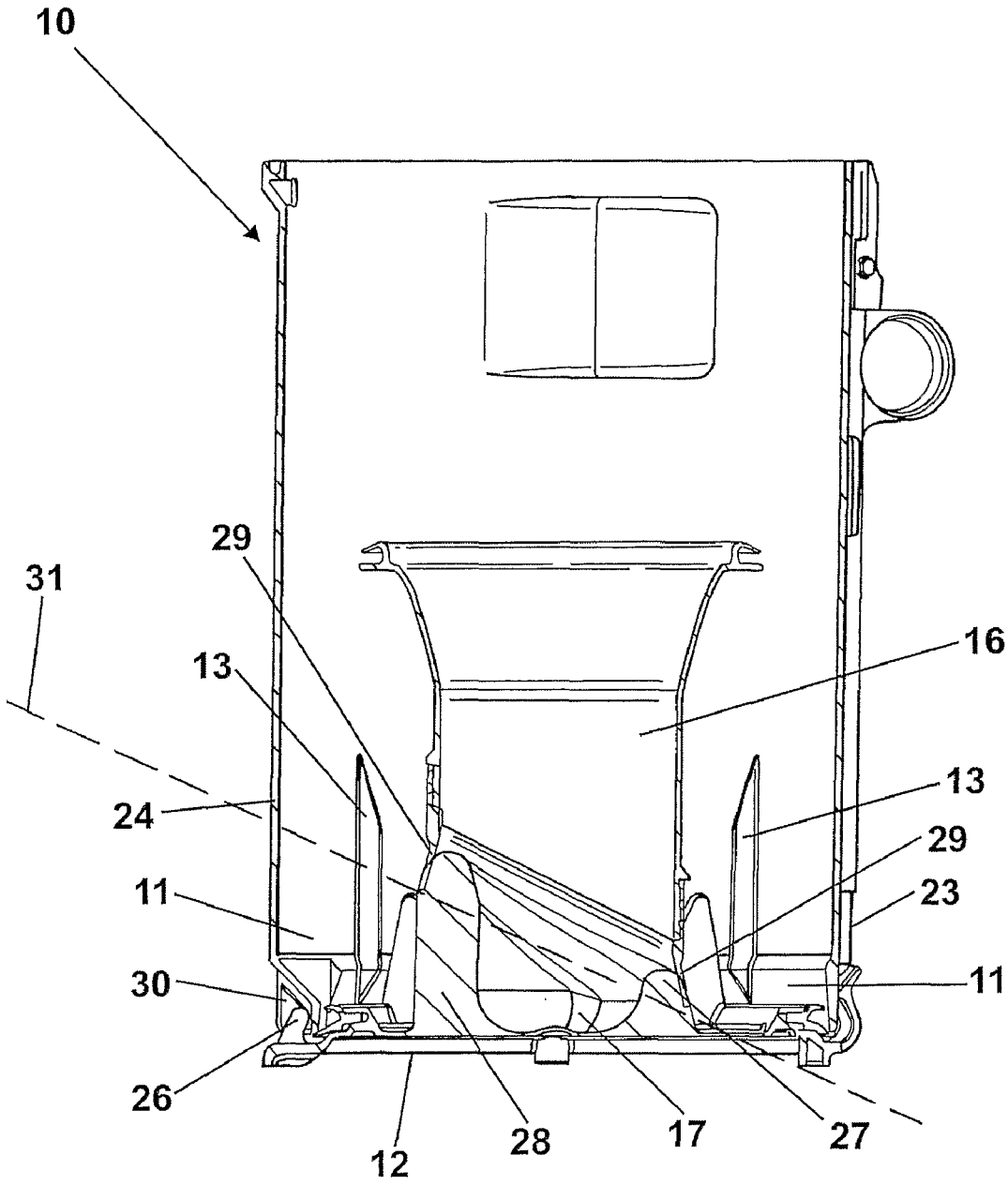
FIG. 3 is a partly sectional side view of part of the collection chamber of FIGS. 1 and 2.
Figure 4:
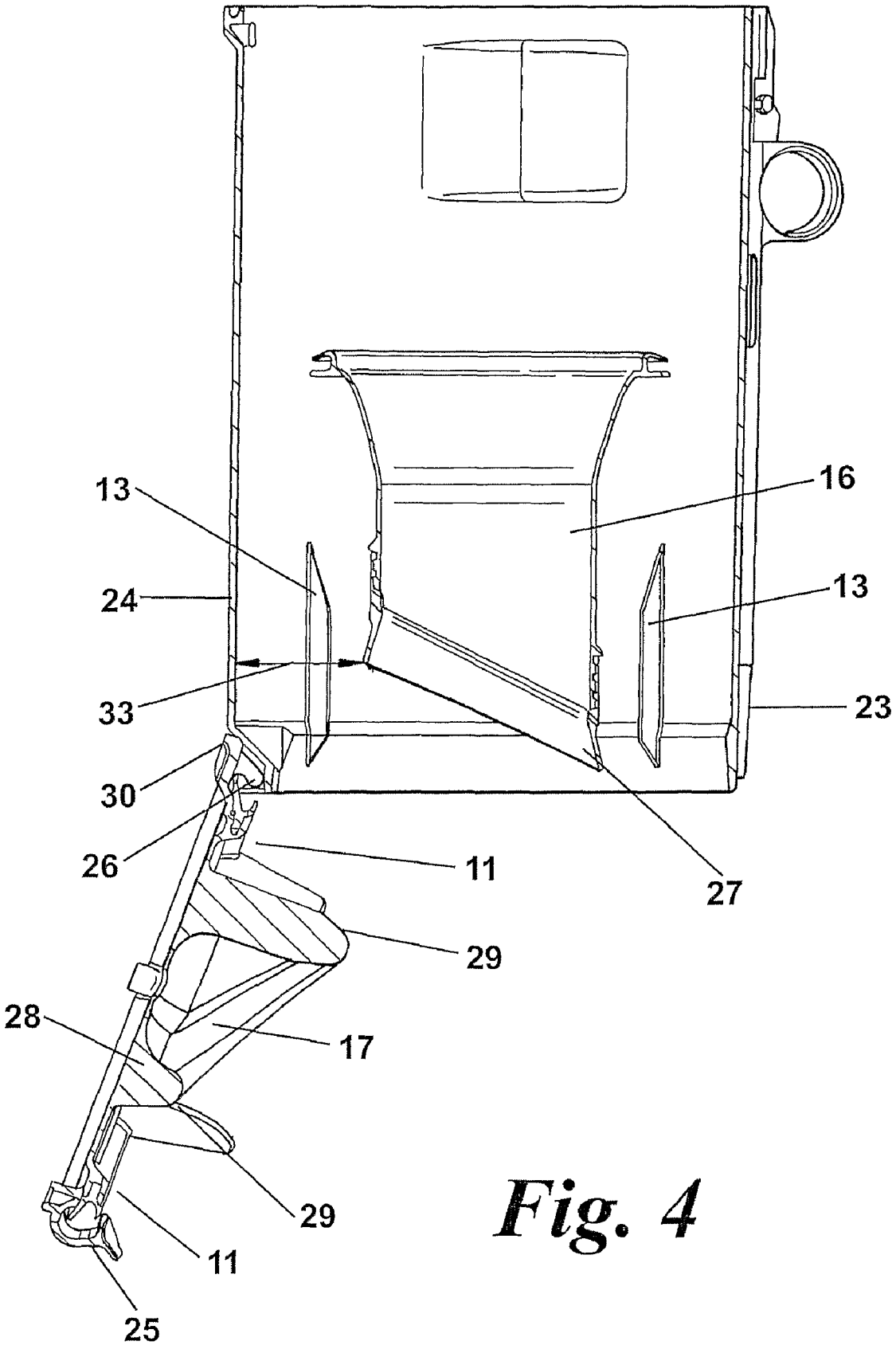
FIG. 4 is a partly sectional side view of the collection chamber of FIG. 3, but with the base open.

An actuator mechanism in the form of a push-button 22 is provided adjacent the handle 21. In order to empty the separator unit 3, the user presses the button 22, as shown in FIG. 2*b*. The button 22 is linked to on end of a push-rod 23 alongside the chamber wall 24. The other end of the push-rod 23 is adjacent the base 12 of the chamber 10. When the user depresses the button 22, the push-rod 23 is urged against a catch 25 on the base 12 (FIGS. 3 and 4). The force exerted by the push-rod 23 overcomes any resistance of the base 12 to move into the open position.

The base 12 is attached to the cyclone chamber 10 by means of a hinge 26 to allow pivotal movement of the base 12 between the open and closed positions. The two separate collection areas 11, 17 lie adjacent to the base 12. The first collection region 11 is the annular region between the cylindrical chamber wall 24 and the dividing wall 16. The second collection region 17 is the region within the wall 16. For good cyclonic separation, it is important that the second collection region is sealed with respect to the first collection region which surrounds it. A seal 27 carried by the dividing wall 16 seals against an upstanding portion 28 on the base 12 to seal off the second collection region 17. The upstanding portion 28 on the base 12 forms a cup for collecting dirt and dust in the second collection region 17, this being material removed from the airflow by the second stage of cyclonic separation. The end 29 of the upstanding portion 28 furthest from the base has an outward taper, so that the seal 27 stretches against the upstanding portion. In this way, the second collecting region 17 is sealed with respect to the first collecting region 11 that surrounds it. This ensures good cyclonic separation at both separation stages.

When the base 12 is pushed open by the push rod 23, the base pivots to the open position and dirt and dust empties from both of the collection regions 11, 16. The hinge 26 is located in a recess 30 in the collection chamber wall 24. This prevents the hinge 26 from being damaged or tampered with. However, the recess 30 projects into the volume of the collecting chamber 10, which could impede emptying of dirt and dust from, in particular, the first collection region 11.

In accordance with the invention, there is a separation between the dividing wall 16 and the base 12 which is not constant. Different parts of the wall 16 are separated from the base 12 by different respective distances. In particular, the distance between the dividing wall 16 and the base 12 is greatest in the region nearest the recess 30. In this embodiment of the invention, this is realised by arranging for the seal 27 that defines the end of the dividing wall 16 to lie in a plane inclined at an angle to the base of the chamber when in the closed position, as shown by the broken line 31. The inclination is such that the inclined edges of the wall 16 as defined by the edge of the seal 27 faces the recess 30.

Figure 5:
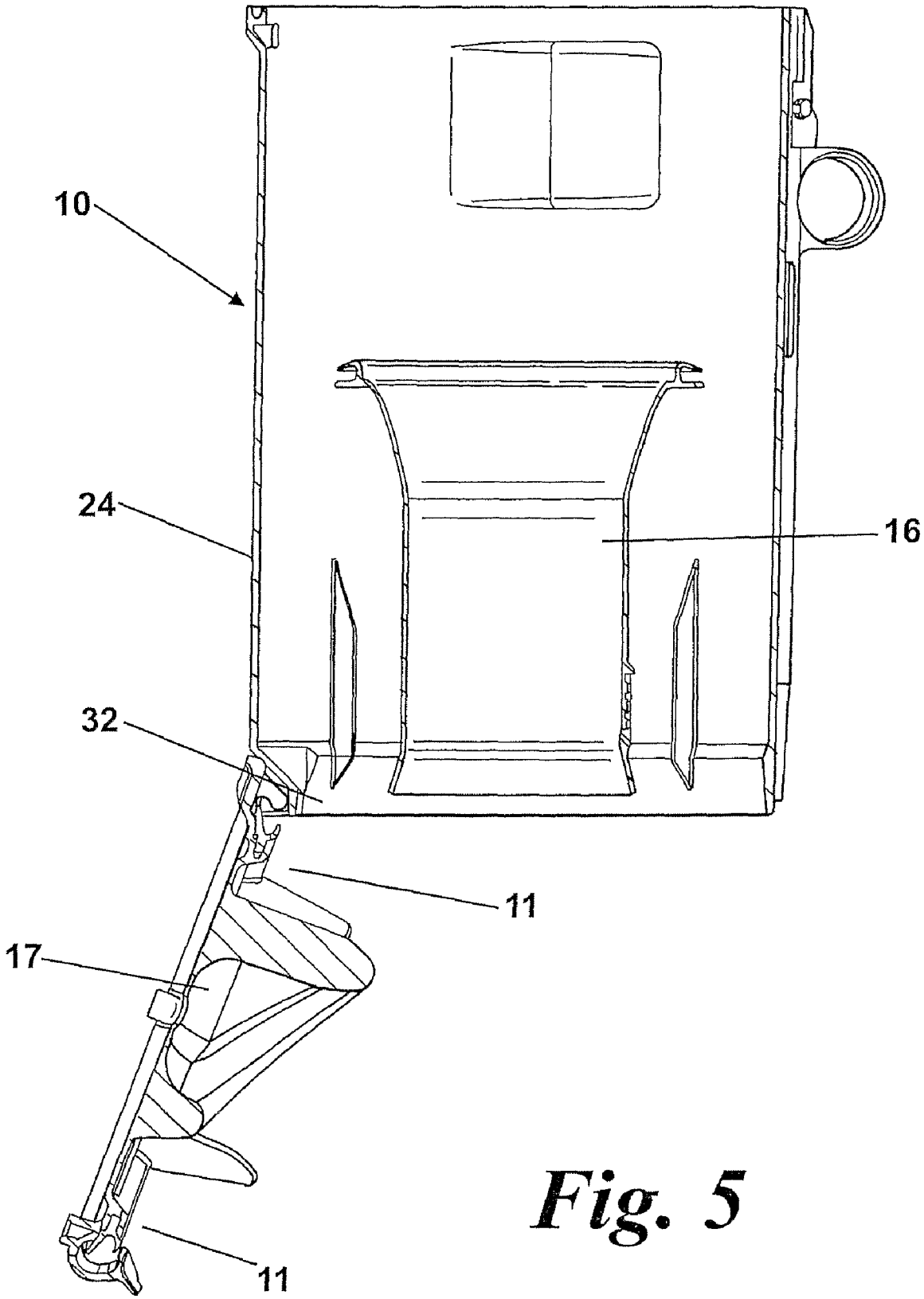
FIG. 5 shows part of another collection chamber with an open base.

Conventionally, the separation between the wall 16 and the base 12 has been substantially constant, so that the end of the wall lies in a plane parallel to the plane of the base when in the closed position. A typical arrangement is shown in FIG. 5. The provision of a recessed hinge arrangement causes a narrowing of the path by which dirt and dust escapes from the first collection region in the vicinity of the recess. This can cause dirt and dust to jam in the area indicated by the reference numeral 32. This can prevent efficient emptying of the collection chamber.

Referring back to FIG. 4, when the base is in the open position, the path for dirt and dust to escape from the first collection region 11 is larger than was achievable hitherto. This is because the separation between the end of dividing wall 16 and the chamber wall 24 is greater than that of the conventional arrangement of FIG. 5. Preferably, the separation is at least that of the radial separation between the dividing wall 16 and the chamber wall 24, as indicated by the reference numeral 33.

The enlarged separation between the end of the wall 16 and the base 12 may also assist the user in emptying and cleaning the collecting chamber in other ways. The inclination of the end of the seal 27 on the dividing wall 16 presents an enlarged opening in comparison to the arrangement of FIG. 5, in which the end of the wall is substantially parallel with the base 12. This assists the user in cleaning the interior of the collecting chamber 10 and particularly the conduit formed by the dividing wall 16. The cup defined by the upstanding portion 28 has a corresponding inclination in order to mate against the seal 27. This also provides an enlarged effective opening, which facilitates emptying and cleaning of the second dust collecting region 17.

Figure 6:
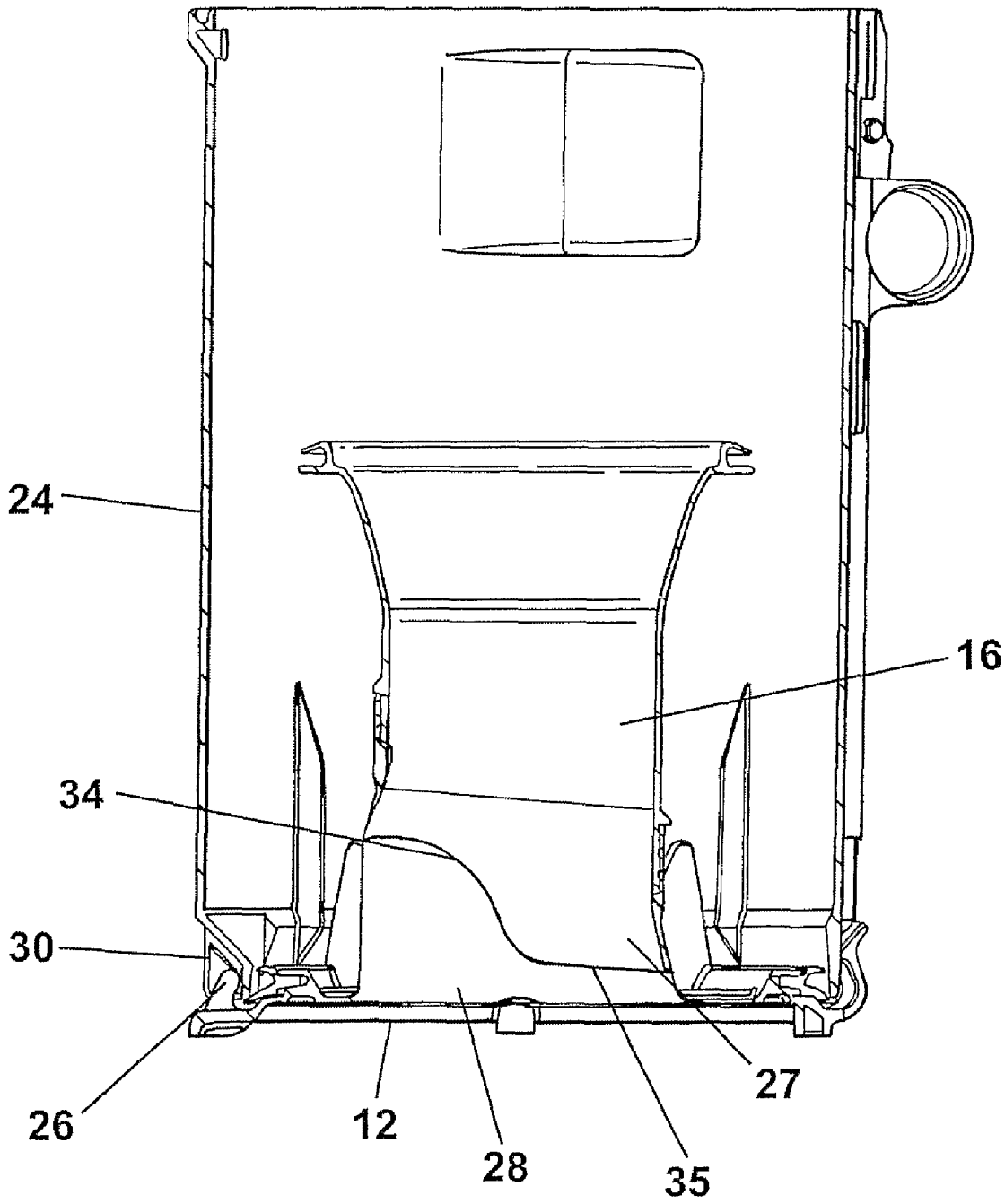
FIG. 6 is a side view of part of another embodiment of the invention.

FIG. 6 illustrates an alternative embodiment of the invention. In the arrangement of FIG. 6, part of the edge of the wall 16, as defined by the seal 27, is substantially parallel to the base 12. The edge nearest the hinge 26 in the recess 30 has a concave surface such that this region 34 is spaced from the base by a greater amount than the region 35 parallel with the base 12.

Figure 7:
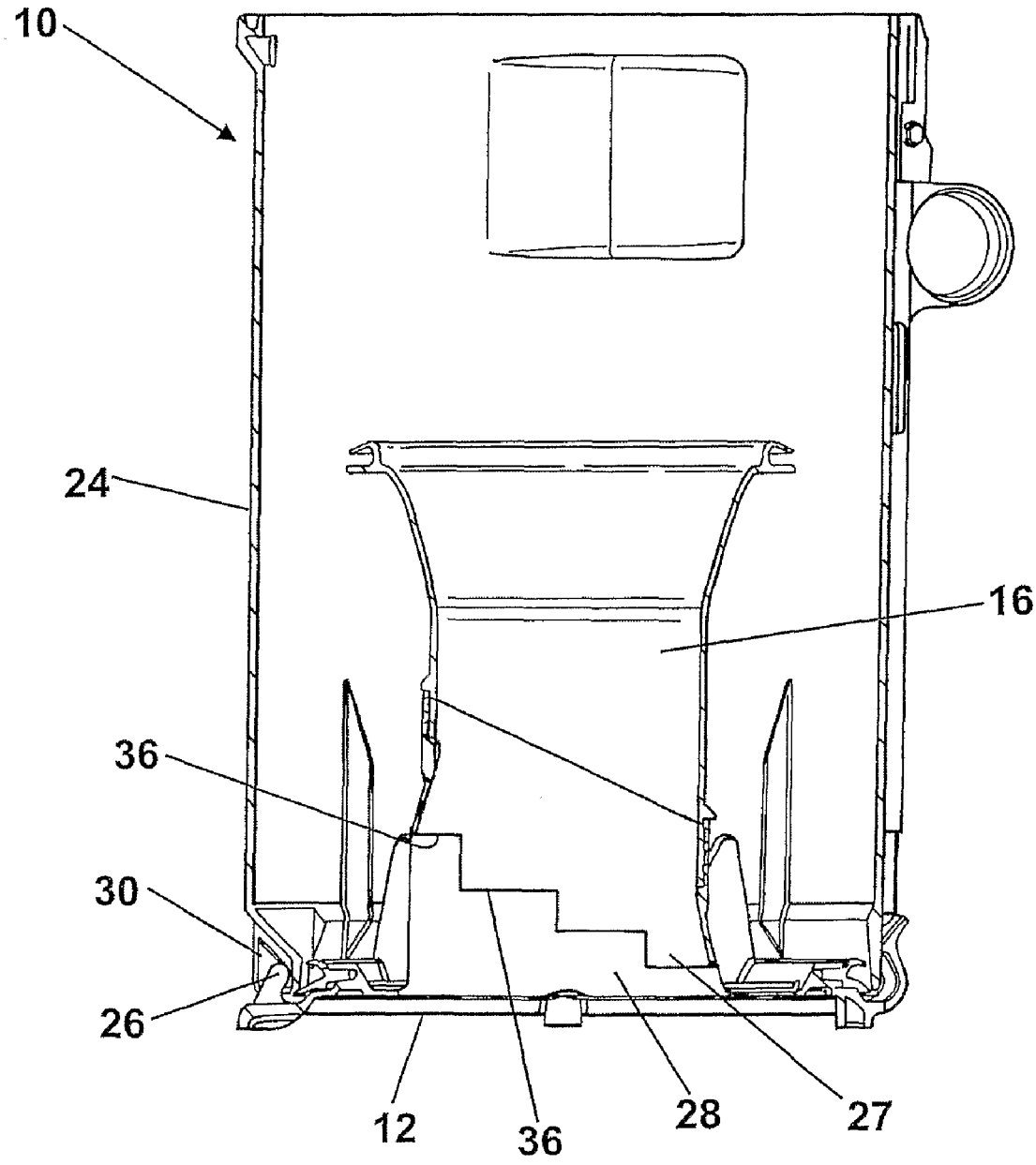
FIG. 7 is a side view of part of a further alternative embodiment of the invention.

FIG. 7 illustrates a further embodiment of the invention. In this embodiment, the end of the wall 16 as defined by the seal 27 forms a plurality of steps 36. The steps ascend as one moves closer to the hinge, so that there is a greater separation between the end of the wall and the base 12 in the region nearest the recess 30.

All of these arrangements provide a path for dirt and dust to escape from the collection chamber of an increased cross-section compared with an arrangement in which the end of the wall and/or the seal lies in a plane parallel with the base of the chamber. In such an arrangement, an improvement in the cross-sectional area for dirt and dust to escape from the collection chamber can be achieved only by removing the recess in the chamber and arranging for the hinge to be mounted on the exterior of the chamber, such as is shown in EP 1361814. However, mounting the hinge in this manner leaves it vulnerable to damage.

Further variations may be made without departing from the scope of the invention. For example, the seal 27 may be carried by the cup defined by the upstanding portion 28 of the base 12. In this alternative arrangement, the end of the dividing wall 16 itself will be separated from the base 12 by different distances in different respective regions. Alternatively, both the dividing wall and the upstanding portion may have corresponding seals.

In the illustrated embodiments, different parts of the upstanding portion project from the base by different distances such that the shape of the top edge of the cup corresponds to the shape of the end of the dividing wall. This facilitates sealing of the dividing wall to the cup. However, the contour of the cup need not correspond to that of the end of the dividing wall.

The invention has been described with reference to a collecting chamber having a pivotably-opening base. However, other emptying mechanisms may be employed. For example, the base may be slidably removable, or the dividing wall may be removed from the top of the chamber. In these arrangements, the recess could accommodate some other mechanism or component of the appliance other than a hinge.

The invention claimed is:

1. A collecting chamber for a bagless vacuum cleaner comprising:

a chamber wall, a chamber base, first and second stage collection regions for collecting, in use, dirt and dust which has been separated from an airflow, and a dividing wall between the collection regions, in which the dividing wall is spaced from the base and the end of the dividing wall adjacent the base is spaced from the base by different distances at different respective regions.

2. A collecting chamber as claimed in claim 1, in which at least part of an end portion of the dividing wall is arranged to lie in a plane inclined at an angle to the chamber base.

3. A collecting chamber as claimed in claim 1, in which an end portion of the dividing wall comprises a seal arranged to seal against the base.

4. A collecting chamber as claimed in claim 3, in which the seal is arranged to seal against an upstanding portion of the base.

5. A collecting chamber as claimed in claim 4, in which the seal is resiliently flexible and is arranged to stretch over the upstanding portion of the base.

6. A collecting chamber as claimed in claim 4 or 5, in which part of the upstanding portion has an outward inclination with respect to the longitudinal axis of the seal.

7. A collecting chamber as claimed in claim 1, in which the base is pivotably movable between a closed position and an open position in which dirt and dust can escape from the collection regions.

8. A collecting chamber as claimed in claim 7, in which the base is pivotably connected to the chamber wall by means of a hinge located in a recess in the chamber wall.

9. A collecting chamber as claimed in claim 8, in which the recess extends into a collecting region.

10. A collecting chamber as claimed in claim 8 or 9, in which the separation between the dividing wall and the base is greatest for the region of dividing wall nearest the recess.

11. A collecting chamber as claimed in claim 8 or 9, in which a portion of the end region is inclined with respect to the base such that the inclined portion faces the recess.

12. A collecting chamber as claimed in claim 1, further comprising releasing means operable to apply an opening force to the base.

13. A collecting chamber as claimed in claim 12, further comprising a handle for carrying the collecting chamber and an actuating member for operating the releasing means, in which the actuating member is located adjacent the handle.

14. A collecting chamber as claimed in claim 13, in which the actuating member is a trigger mechanism which is located beneath the handle.

15. A collecting chamber as claimed in claim 1, in which the second stage collection region lies within the first stage collection region.

16. A collecting chamber as claimed in claim 1, further comprising a cyclonic separator.

17. A collecting chamber as claimed in claim 10, in which a portion of the end region is inclined with respect to the base such that the inclined portion faces the recess.

* * * * *